US005563811A

United States Patent [19]

Embree

[11] Patent Number: 5,563,811

[45] Date of Patent: Oct. 8, 1996

[54] MICROPROCESSOR CONTROLLED DRIVE CIRCUIT FOR A LIQUID NEBULIZER HAVING A PLURALITY OF OSCILLATORS

[75] Inventor: Cecil W. Embree, Toronto, Canada

[73] Assignee: Humonics International Inc., Ontario, Canada

[21] Appl. No.: 55,056

[22] Filed: Apr. 29, 1993

[51] Int. Cl.[6] ..... B06B 1/02; F24F 6/12

[52] U.S. Cl. ..... 364/573; 364/571.01; 331/15; 331/34; 331/109; 331/182; 331/183; 236/1 F; 236/44 A

[58] Field of Search ..... 364/573, 571.01, 364/571.02, 505, 176, 579, 138; 236/1 F, 44 R, 44 A; 331/15, 23, 34, 109, 182, 183

[56] References Cited

U.S. PATENT DOCUMENTS

| | | | |
|---|---|---|---|
| 3,828,773 | 8/1974 | Buch et al. | 128/194 |
| 3,973,220 | 8/1976 | Fender et al. | 331/109 |
| 3,989,042 | 11/1976 | Mitsui et al. | 128/194 |
| 4,161,660 | 7/1979 | Gallant | 236/44 R X |
| 4,212,078 | 7/1980 | Games et al. | 364/900 |
| 4,300,131 | 11/1991 | Mitsui et al. | 340/618 |
| 4,318,062 | 3/1982 | Mitsui et al. | 331/109 |
| 4,359,697 | 11/1982 | Takahashi | 331/116 R |
| 4,546,916 | 10/1985 | Tsuaki | 236/44 A |
| 4,641,053 | 2/1987 | Takeda | 310/317 |
| 4,643,351 | 2/1987 | Fukamachi et al. | 236/44 E |
| 4,820,453 | 4/1989 | Huang | 21/26 |
| 4,873,648 | 10/1989 | Mouser et al. | 364/500 |
| 4,996,502 | 2/1991 | Endo | 331/46 |
| 5,047,734 | 9/1991 | Newell et al. | 331/46 |
| 5,176,856 | 1/1993 | Takahashi et al. | 261/142 |
| 5,189,380 | 2/1993 | Tavis | 331/109 |

FOREIGN PATENT DOCUMENTS

| | | |
|---|---|---|
| 316545 | 9/1988 | European Pat. Off. . |
| 359217 | 9/1989 | European Pat. Off. . |
| 424685 | 9/1990 | European Pat. Off. . |
| 442510 | 2/1991 | European Pat. Off. . |
| 4013607 | 10/1991 | Germany . |

*Primary Examiner*—Ellis B. Ramirez
*Assistant Examiner*—M. Kemper
*Attorney, Agent, or Firm*—Joseph P. Gastel

[57] ABSTRACT

A circuit for causing an element to produce a substantially linear response to an input signal comprising an element for providing a response, a transistor oscillator circuit for providing an electrical output signal of variable amplitude to excite the element in response to the input signal, the transistor oscillator circuit normally causing the electrical output signal to vary non-linearly with respect to the input signal, and microprocessor means for correcting the non-linear relationship between the input signal and the electrical output signal to thereby cause the electrical output signal to vary substantially linearly with respect to the input signal when the input signal is applied to the microprocessor means.

35 Claims, 9 Drawing Sheets

Microfiche Appendix Included
(32 Microfiche, 1 Pages)

MICROPROCESSOR CONTROLLED DRIVE CIRCUIT FOR A LIQUID NEBULIZER HAVING A PLURALITY OF OSCILLATORS

This patent includes a microfiche appendix in accordance with 37 C.F.R. §1.96(b) including a single microfiche having 32 frames.

BACKGROUND OF THE INVENTION

The present invention relates generally to a nebulizer circuit for converting water into mist for humidification purposes at a rate which is proportional to an input demand for humidification. More particularly, the invention relates to a microprocessor-controlled circuit for causing an oscillator, which normally produces a non-linear output in response to said input demand, to produce an output which is linearly proportional to said demand, to thereby provide precise control of humidification and to conserve electrical energy.

By way of background, humidification systems utilizing piezoelectric transducers to generate mist from water are driven by transistor-containing oscillators. However, the output from such oscillators is non-linear with respect to an input demand which indicates the amount of humidification required. This is due to the non-linear input-output characteristics of the transistor within the oscillator. This results in driving the transducers at much higher amplitudes than is usually required which, in turn, generates mist at much higher rates than is usually required which, in turn, results in lack of precise control of humidification and the waste of electrical energy. In the foregoing respect, for example, if the humidity sensor indicates that the actual humidity is 10% below a set humidity, the oscillator, which operates non-linearly, may drive the transducer at a rate which is equivalent to a 90%–100% requirement. This, in turn, not only requires excess electrical energy, but also causes the actual humidity to overshoot the desired level, which also results in excess electrical consumption. In contrast to the foregoing mode of operation, if the transducer could be driven at a rate which is linearly proportional to the demand for humidification, there would be no significant overshooting of the humidity or consumption of excessive amounts of electrical energy. More specifically, for example, if the sensor indicates that a 10% increase in humidity is required, if the transducer could be driven initially at an amplitude proportional to the 10% increase, and then gradually decreased in amplitude as there is a sensing of an increase in humidity, that is, linearly in relation to the input demand signal, there will be no overshooting and thus there will be precise control of the humidity and also there will be no excessive consumption of electrical energy. However, as noted above, transistor-containing oscillators are inherently not capable of producing an output which is linear in relation to a linear input.

As noted above, then, perhaps the most significant problem in a humidification system is that of achieving a linear relationship between an input demand signal (which indicates the desired mist output) and the mist output determined by the piezo-electric crystal. The problem arises because of the inherently non-linear input-output characteristics of the oscillator circuit and its main component, a transistor.

It is especially necessary to solve the "non-linearity" problem in automatic humidification systems, such as those which are used in commercial office buildings and the like, where significant amounts of electrical energy can be lost without precise control. In a typical automatic system, a humidity sensor determines the humidity level in a room, compares the measured level with a predetermined desired level, and sends a control signal to the oscillator drive circuit to adjust the amount of misting accordingly. Obviously, precise control is difficult to achieve unless there is a linear relationship between the control signal and the output of the drive circuit.

In addition to the foregoing, while residential, single-room humidifiers typically have only a single crystal and associated oscillator, commercial systems typically have many crystals which are necessary to nebulize larger volumes of liquid. A problem which arises in multiple-crystal systems is to ensure that all oscillators in the system respond to a common control signal in the same way. For example, if a common control signal is applied to eight different oscillator drive circuits, it is desired that all eight systems would produce the same amount of misting.

Finally, a problem inherent in all nebulizing systems is the generation of faults which affect system performance. These faults can take many forms. For example, the crystal or its associated drive transistor can short-circuit; the reservoir can develop a low liquid level; a power failure can occur, etc. It is desired that the system recognize certain of these faults and take appropriate corrective action.

SUMMARY OF THE INVENTION

It is accordingly one object of the present invention to provide a humidification system which precisely controls the rate of humidification produced by a piezo-electric transducer in response to the demand for humidification and thus conserves electrical energy.

Another object of the present invention is to provide a microprocessor-controlled oscillator circuit which produces a linear output which is linearly proportional to the variable demand for humidification.

A further object of the invention is to provide a means of uniformly controlling a plurality of oscillator circuits in a nebulizer in order that each of the misting elements associated with the circuits will produce substantially the same amount of mist in response to a single control signal.

A still further object of the invention is to provide a means of recognizing various faults in a nebulizer, indicating the existence of these faults, and taking appropriate action in response thereto.

These and further features, objects and advantages of the invention will become apparent to those skilled in the art from the following detailed description, drawings and claims.

The present invention broadly includes a circuit for causing an element to produce a substantially linear response to an input signal comprising an element for providing a response, a transistor oscillator circuit for providing an electrical output signal of variable amplitude to excite the element in response to the input signal, the transistor oscillator circuit normally causing the electrical output signal to vary non-linearly with respect to the input signal, and microprocessor means for correcting the nonlinear relationship between the input signal and the electrical output signal to thereby cause the electrical output signal to vary substantially linearly with respect to the input signal when the input signal is applied to the microprocessor means.

Also, the invention provides a system for producing controlled humidification comprising a piezo-electric crystal for producing ultrasonic vibration to nebulize water for humidification, oscillator means for exciting the piezoelectric crystal, sensor means for sensing the humidity level and for comparing the sensed humidity level to a preset desired humidity level and for generating a humidity demand signal, and control means for causing the oscillator means to produce an output of an amplitude which varies substantially linearly with respect to the humidity demand signal.

Finally, the invention provides an apparatus for providing controlled excitation to a plurality of elements which generate ultrasonic waves, comprising a plurality of transistor oscillator circuits, each of which provides an electrical output signal of a variable amplitude to excite one of the elements in response to an input bias signal, wherein the amplitude of the electrical signal varies non-linearly with respect to the input bias signal, microprocessor means for correcting for the non-linear relationship between the input bias signal and the electrical output signal, wherein the microprocessor means receives an input signal and transmits a single output control signal in response thereto to each of the oscillator circuits which, in turn, produce an electrical output signal whose amplitude varies linearly with respect to the input signal, and, a corresponding plurality of variance adjustment circuits which ensure that the amplitude of the electrical output signal for each of the oscillator circuits is the same in response to the control signal.

DETAILED DESCRIPTION OF THE PREFERRED EMBODIMENT

At the outset, it should be understood that, in the description of the block and schematic diagrams that follow, certain simplifications have been made to facilitate understanding. For example, multiple data and control lines have been replaced by single lines to simplify the drawings. Also, generic elements, common to all microprocessor circuits, have been omitted for simplicity. For example, the crystal oscillator which provides the clock for the microprocessor, as well as many power supply and ground connections for the integrated circuits, have not been shown. To facilitate making and using the control circuit, many resistor, capacitor, and inductor values are shown in the accompanying drawings, although these values could be readily determined by one having ordinary skill in the art.

In the description which follows, the preferred embodiment is used to control a humidification system. It is to be understood, however, that the control circuit is suitable to control a variety of nebulizer and atomizer systems. In fact, the control circuit is not limited in its application to nebulizers, but would be useful to correct for the non-linear input-output characteristics of many different types of systems.

Figure 1:
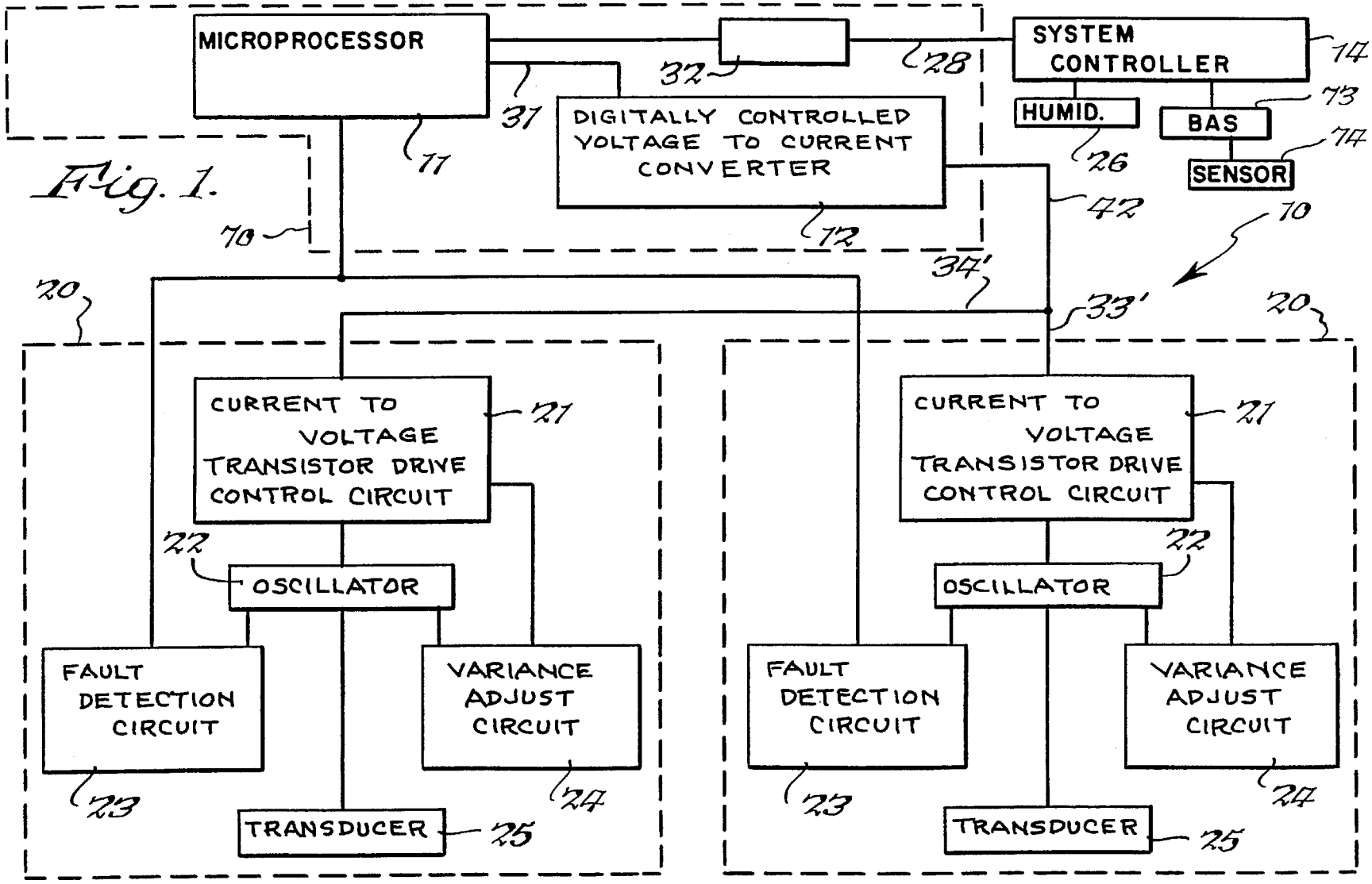
FIG. 1 is a block diagram of the control circuit of the invention.

FIG. 1 is a block diagram of a microprocessor controlled drive circuit 10 for a liquid nebulizer having a plurality of oscillators 22, each of which contain a transistor. Oscillators of this type produce a non-linear output in response to an input. Microprocessor 11 receives an input demand signal proportional to the amount of humidity required to bring the room humidity to a preset level via line 28 (via RS-485 communication link 32) from a system controller 14 (described in more detail infra.)

The system controller is the interface between the remote controllers of the humidifiers and the various types of humidity control signals as well as allowing operator control of the humidifiers via a user interface comprised of a keypad and liquid crystal display. In addition, the system controller monitors the operational status of each humidifier and alarms the user on a humidifier fault. Finally, the system controller receives a humidity control signal from a building automation system (BAS) 73 which monitors the humidity in a particular location or zone using a sensor 74. Sensor 74 provides BAS 73 with a signal which is proportional to the zone humidity. The BAS compares the signal to the preset desired humidity level and generates an analog humidity demand signal which is proportional to the amount of humidity necessary to bring the room level or zone up to the preset level. Also shown in FIG. 1 is humidistat 26 which provides an on/off contact closure (typically 24 VAC when on) to the system controller via line 29. Although both humidistat 26 and sensor 74 are shown in both FIGS. 1 and 4, in an actual system, only one or the other type of sensing device would be employed.

Remote controller 70 comprises microprocessor 11, digitally controlled voltage to current converter 12, and communication link 32.

Figure 4:
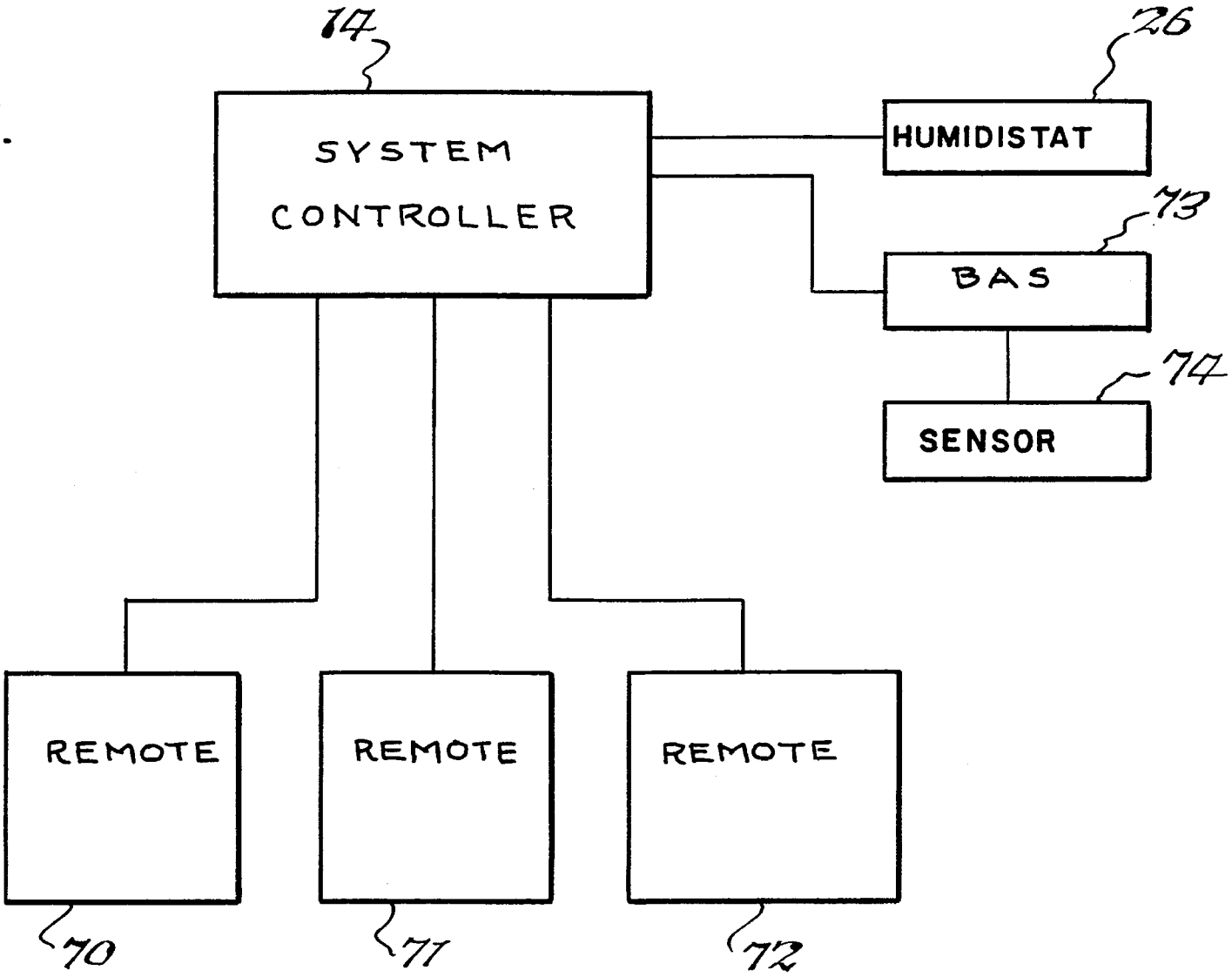
FIG. 4 is a block diagram which illustrates a typical system in which the present invention would be used.

As shown in FIG. 4, in a typical humidification system, the system controller 14 controls a plurality of remote controllers (eg., 70, 71, 72, etc.), although only a single remote controller is shown in FIG. 1. Also as shown in FIG. 4, the system controller can receive its input signals from sources other than a building automation system; a simple on/off humidistat sensor 26 for example. In this instance the humidifier is turned on or off in response to the humidistat signal with the maximum humidifier output being fixed by the user using the keypad of the system controller.

In a preferred embodiment, the input signal received from the controller 14 by microprocessor 11 is a digital word which corresponds to the analog voltage signal of the humidity sensor 74. Again, the analog voltage signal of the humidity sensor represents the difference between the measured humidity and the desired humidity levels, and hence is a humidity demand signal. Software, embedded in the microprocessor, (and provided in the microfiche appendix) applies a corrective factor to this input word from controller 14 to calculate the necessary digital value of the control voltage required to adjust the output of the humidifier transducers linearly as a function of the input signal. This is the main function of the microprocessor.

After correcting the non-linearity, microprocessor 11 sends a digital word via line 31 to digitally controlled voltage to current converter 12 (hereinafter V-I converter 12). As will be explained infra, converter 12 provides control signals to a plurality of transducer drive circuits, each of which controls an individual transducer. For simplicity, only two identical drive circuits 20 are shown in FIG. 1, although it is to be understood that each converter is capable of driving many drive circuits. As shown in the figure, output signals are provided by converter 12 along line 42, and then in parallel along lines 33' and 34' to drive circuits 20, respectively.

Transducer drive circuits 20 are identical. Each drive circuit 20 comprises five basic elements: current to voltage transistor drive control circuit 21 (hereinafter I/V drive circuit 21), oscillator 22, transducer 25, fault detection circuit 23 and variance adjust circuit 24. Each of these elements will be described in detail in relation to the remaining drawing figures.

Figure 2:
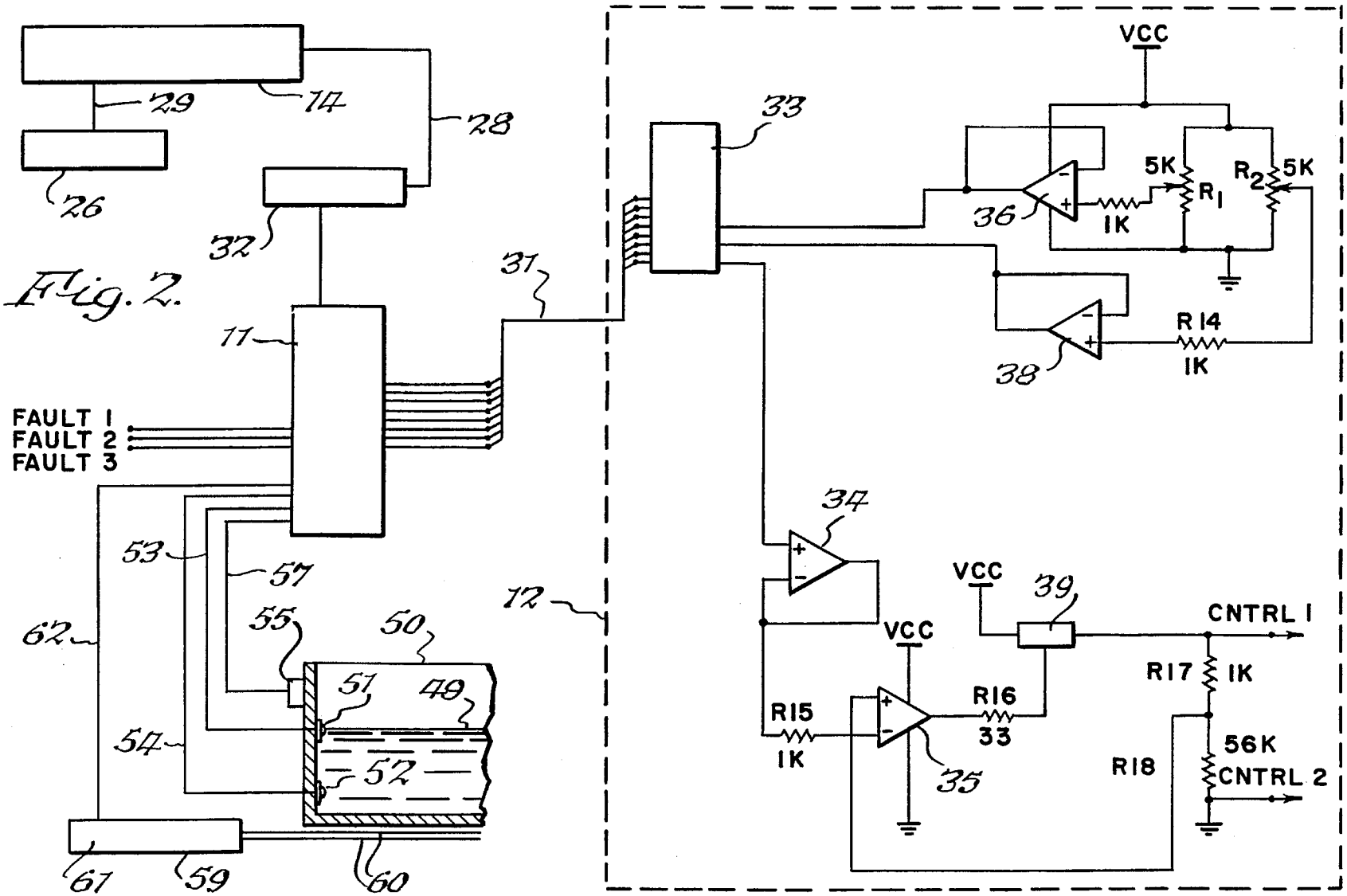
FIG. 2 is a partial schematic diagram of the control circuit of the invention.

FIG. 2 illustrates in more detail a partial schematic diagram of the control circuit of the invention. The heart of the circuit is microprocessor 11 (Signetics 87C51CCN40, or equivalent). This microprocessor has the following major functions:

1. Receive a digital word representing the humidity demand signal from system controller 14;
2. Calculate the analog output signal necessary to achieve linear control of the humidifier output;
3. Monitor and control the water level in the humidifier pan; and,
4. Monitor status signals within the humidifier and communicate faults to a main system controller (not shown).

Microprocessor 11 receives its input information (i.e., a digital humidity demand signal) from system controller 14, which, in turn, receives an analog humidity demand signal from BAS 73 which receives an analog humidity signal from sensor 74 (Multisens Inc. Model DM-1001, or equivalent, for example.) The information is communicated to microprocessor 11 via RS-485 transceiver 32 (Linear Technology LTC485CN8, or equivalent). Similarly, in a large building, a plurality of remote controllers may be linked to a central system controller 14, as shown in FIG. 4.

Sensor 74 measures the humidity within a room and produces an analog signal typically in the range of 0–10 volts or 4–20 milliamperes, which is proportional to the humidity level. BAS 73 compares the output of sensor 74 to the desired set point and generates an analog signal typically in the range of 0–10 volts or 4–20 milliamperes which is proportional to the needed humidity to bring the room up to the desired level. For example, if the humidity level is 10% below a preset value, the signal will be less than if its humidity level is 20% below the preset value. This analog signal is sent to system controller 14 where it is digitized before being sent to microprocessor 11 as a humidity demand signal. The software embedded in microprocessor 11 (and provided in the microfiche appendix) then applies a corrective factor to the digital input signal and calculates the necessary digital value of the control voltage required to adjust the oscillator driven output of the humidifier transducers to allow the output of the humidifier to be controlled as a linear function of the input signal. At this point, it is to be again noted that, without the operation of the microprocessor, the output of the oscillator will be non-linear with respect to the input signal because of the inherent nature of an oscillator containing a transistor. A new digital command signal is then sent to V/I converter 12 via line 31 which, in turn, controls the individual oscillator drive circuits.

Voltage converter 12 comprises digital to analog converter 33 (National Semiconductor DAC0822LCN, or equivalent), operational amplifiers 34, 35, 36, and 38 (National Semiconductor LM358AN, or equivalent) (hereinafter "op amps"), and an NPN transistor 39 (Motorola TIP31C, or equivalent).

The digital to analog converter 33 is used in the voltage switching mode to eliminate the need for a temperature compensated reference voltage, zero and fullscale trim procedures, and the additional circuitry that otherwise would be required if used in the current mode. The digital to analog conversion is based on 8 bits, but can be 10, 12, or 16 bits if greater accuracy of output control is desired.

Digital to analog converter 33 receives a digital command signal from microprocessor 11 via line 31, and transmits an output analog signal which is buffered by op amp 34. The output of op amp 34 is applied to the base of transistor 39 via op amp 35. A feedback loop from the output of transistor 39 to op amp 35 ensures stability and accuracy of the control signal to the transducer driver circuits. In this manner, any number of transducer circuits can be connected to the output control signal, increasing the current load on the transistor 39, but maintaining a constant voltage output and therefore a constant current through each individual transducer driver circuit.

The range of the output voltage of converter 33 is determined by op amps 36 and 38. The minimum value of the output is adjusted by variable resistor $R_2$ and buffered by op amp 38. The maximum value is adjusted by variable resistor $R_1$ and buffered by op amp 36. The outputs $CNTRL_1$ and $CNTRL_2$ of V-I converter 12 are connected to optoisolator $OP_1$ (shown in FIG. 3).

Figure 3:
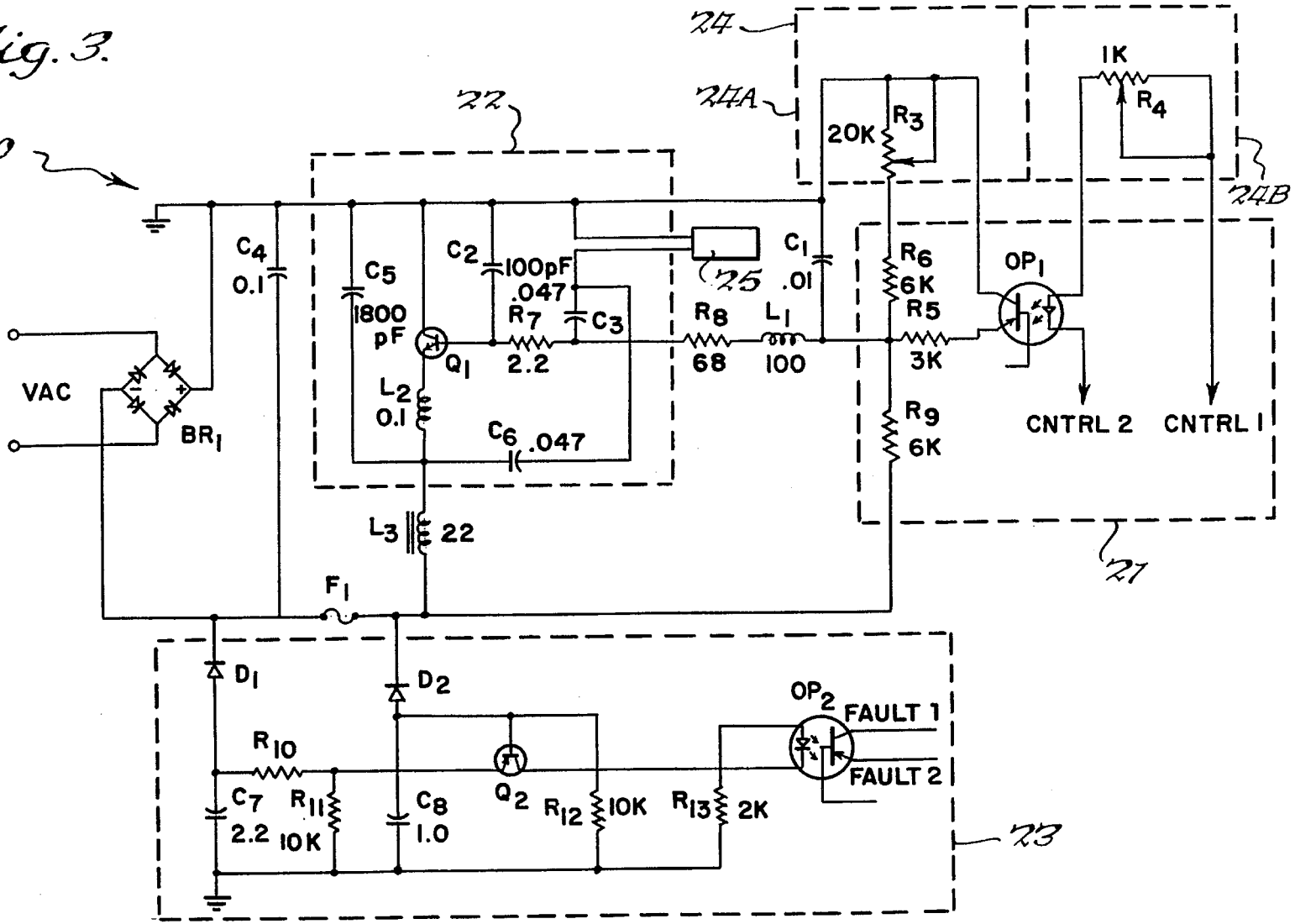
FIG. 3 is a partial schematic diagram of the control circuit of the invention.

FIG. 3 is a schematic diagram of transducer drive circuit 20. The drive circuit contains I/V transistor drive control circuit 21, oscillator 22, transducer 25, fault detection circuit 23 and variance adjust circuit 24.

I/V drive circuit 21 comprises optoisolator $OP_1$ (Motorola 4N25, or equivalent) which functions to convert the current signal provided via $CNTRL_1$ and $CNTRL_2$ to a corresponding voltage signal to modulate the bias current of transistor $Q_1$ in the oscillator. The optoisolator and resistor $R_5$ are in parallel with resistor $R_6$ and variable resistor $R_3$. As current through the light emitting diode side of the optoisolator changes, so does the current through the transistor output side of the optoisolator. The bias current then increases as the control current increases and decreases as the control current decreases, all under software control. The optoisolator isolates the high voltage transducer driver circuits from the low voltage control circuitry and accommodates connection of multiple driver circuits to one control signal.

Oscillator 22 is a modified Colpitts oscillator in which the collector of the transistor $Q_1$ is grounded. The oscillating loop is comprised of the components $Q_1$, $C_3$, $C_6$, $C_5$ and the piezo-electric crystal transducer 25 (an industry standard transducer model PZT-4, or equivalent). The transducer has a series-parallel equivalent circuit with the reactance being capacitive below the resonant frequency, $f_r$, and inductive between the resonant frequency and the anti-resonant frequency, $f_a$. The circuit/transducer combination operates in the thickness mode between the resonant frequency (1.65 Mhz in a preferred embodiment) and anti-resonant frequency (1.85 Mhz) in that part of the reactance curve which is inductive.

The collector of $Q_1$ and the transducer electrode that is exposed to the water are connected to the ground or zero potential side of the circuit. An alternating voltage is full-wave rectified by the bridge rectifier $BR_1$, and filtered by capacitor $C_4$. The high frequency oscillations occur within the envelope of the full-wave rectified pulsating D.C. voltage. The peak value of the voltage applied to the circuit and the transducer is 135 volts (2×1.414×48 volts ($V_{AC}$)) at 60 Hz.

Inductor $L_3$ filters any high frequency current components. The transistor bias current is determined by the components $R_3$ and $R_4$ (variance adjust), $OP_1$, and resistors $R_6$, $R_5$, and $R_9$. Capacitor $C_1$, inductor $L_1$, and resistor $R_8$ provide filtering for any noise on the bias current resulting from the remote control signal via optoisolator $OP_1$. Resistor $R_7$ and capacitor $C_2$ shape the base current waveform after the summing node of the transducer signal and the bias current. Inductor $L_2$ in the emitter of $Q_1$ functions to shape and stabilize the high frequency waveform.

The main oscillator is designed with one power transistor $Q_1$. For this circuit to function properly, this power transistor must have a very high current gain factor. In any given sample lot, the normal manufacturing tolerances result in approximately a 10% variance in gain factor. Also, the manufacturing tolerances for the piezo-electric crystal transducer will generally not be less than about 10% within any given lot. Therefore, to overcome the operational discrepancies that are inherent from these variances, when a common control signal is used to control multiple transducers, a simple means of adjustment is provided. The variance adjust circuit 24 comprises mist off bias circuit 24A and full mist bias circuit 24B. Within bias circuits 24A and 24B are potentiometers $R_3$ and $R_4$, respectively. These potentiometers permit the adjustment of each driver circuit/transducer combination individually, to ensure that the mist output is the same for all transducers over the full range of the remote control current. With a control current corresponding to zero mist output (referred to in the claims as a first predetermined control/output signal), the mist off bias adjust potentiometer $R_3$ is adjusted to the point where no mist is developed. Similarly, full mist adjust potentiometer $R_4$ is adjusted so that maximum control current (referred to in the claims as a second predetermined control/output signal) results in maximum mist output from the transducer.

Fault detection circuit 23 functions to detect a fault in oscillator transistor $Q_1$ or transducer 25. In the event of a fault, the circuit sends an appropriate signal to microprocessor 11 which, in turns, communicates the fault information to system controller 14. Either of these failures causes excessive current in fuse $F_1$ on the ultrasonic driver board. This fault detection feature enables a user to know immediately that the humidifier is not capable of maximum rated output, as opposed to learning this during a regularly scheduled maintenance period, which could be a considerable amount of time after the failure occurs.

The fault detection circuit monitors the voltage across the fuse. Diode $D_1$ allows capacitor $C_7$ to charge and remain charged as long as the power is on. The voltage on $C_7$ is divided down by resistors $R_{10}$ and $R_{11}$ and applied to the emitter of transistor $Q_2$. Diode $D_2$ allows capacitor $C_8$ to charge and remain charged as long as the fuse has not blown. The voltage on $C_8$ is applied to the base of $Q_2$ and is more negative than the emitter voltage. Therefore, $Q_2$ remains cut off, due to the base-emitter junction being reverse biased, as long as the fuse has not blown. When the fuse opens (due, for example, to transistor $Q_1$ or transducer 25 shorting), resistor $R_{12}$ pulls the base of $Q_1$ to ground, forward biasing the base-emitter junction, and transistor $Q_2$ turns on. When $Q_2$ turns on, current flows through the diode of the optoisolator $OP_2$. This operates the logic level fault detection signal FAULT1 transmitted to microprocessor 11. As shown in FIG. 2, microprocessor 11 is connected to several fault detection lines, (shown as FAULT1, FAULT2, FAULT3), and each line is, in turn, connected to a bank of transducer fault detection circuits (in a preferred embodiment, as many as sixteen on each line).

In addition to the foregoing, the microprocessor 11 provides additional controls. In this respect, as shown in FIG. 2, the water level 49 in tank 50 is controlled by optically actuated sensors 51 and 52 (Honeywell LL10300 or equivalent) which are coupled to microprocessor 11 by lines 53 and 54, respectively. More specifically, when the water level reaches height 49, microprocessor 11 shuts off a water inlet valve (not shown) to tank 50, and if the level should drop below the level detected by sensor 52, microprocessor 11 will shut down the system. In addition, a thermal switch 55 (Airpax 5003 or equivalent) is mounted on tank 50 and coupled to microprocessor 11 by line 57, and it will cause the system to shut down in the event of overheating. Also, a leak detection circuit 59 is provided wherein a pair of open circuit wires 60 with cloth insulation are secured to the bottom of tank 50, and, if they become wet due to leakage from tank 50, the resistance between wires 60 will decrease and the resistance sensing circuit 61 will send a signal to microprocessor 11 via line 62 to shut down the system.

In addition to the features described in detail hereabove, controlling a humidifier with a microprocessor and embedded software permits the easy addition of other beneficial features which are not readily available at the present time. These include:

1. Auto-dump: If, after a period of time, the humidifier has not received a control signal, the microprocessor can be programmed to turn off the transducers and start to drain the humidifier pan of water. This prevents bacterial growth which occurs in standing water.
2. Maximum output setpoints: This allows for a limit to be set on the output of the humidifier. This set point is adjusted through software. This can prevent the build-up of water in the ducts if the air cannot absorb all of the mist produced.
3. Maximum output expansion: This allows for software adjustment of the maximum output signal to the transducers to overcome the fall-off in output due to the natural aging process of the transducers.
4. Water level maintenance: The microprocessor monitors signals from water level sensors to maintain the water level at optimum height for maximum humidifier output and to shut down the humidifier if the water level drops to a minimum safe operating point. The microprocessor controls the water by operating an inlet valve and can drain the humidifier pan by operating a drain valve.

The System Controller

For installations requiring that a plurality of humidifiers be controlled from a common control signal, and/or common alarm signals, or a combination thereof, a system controller can be used. The system controller, as mentioned earlier, is the interface between the humidifiers and the controlling signals. It also provides user control and reports on the status of each humidifier. This facilitates system trouble-shooting and also provides a means for remotely monitoring an alarm condition. The system controller board can be made to respond differently to the conditions and signals particular to each installation by simply changing the controlling software.

Figure 5:
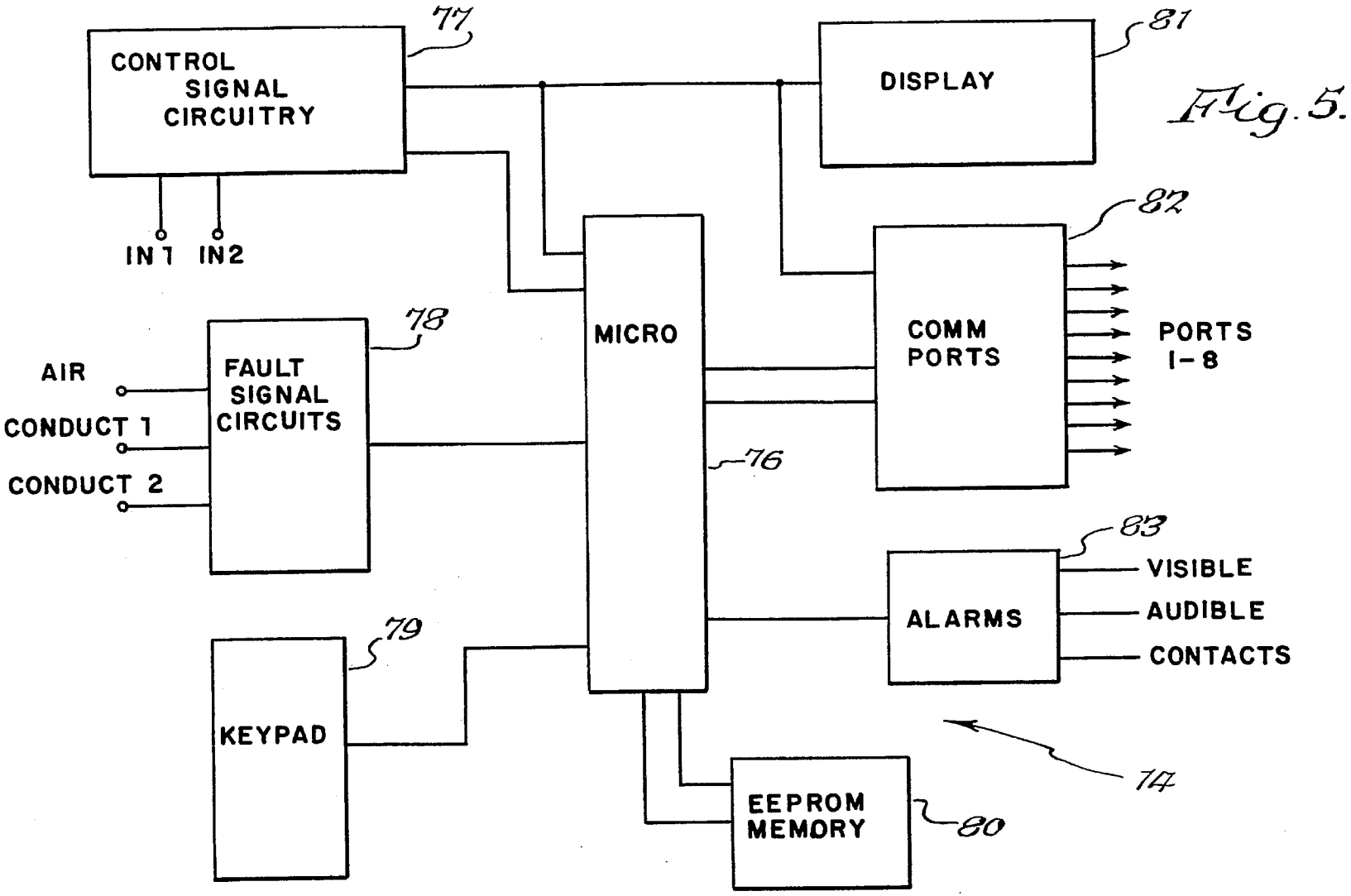
FIG. 5 is a block diagram of the system controller of the invention.

As shown in FIG. 5, system controller 14 broadly comprises microprocessor 76 (8 bit, Signetics 87C51CCF40, or equivalent), control signal circuitry 77, fault signal circuits 78, keypad 79, EEPROM memory 80, display 81, communication ports 82 and alarm circuitry 83.

System Control Signal Circuitry

Figure 6:
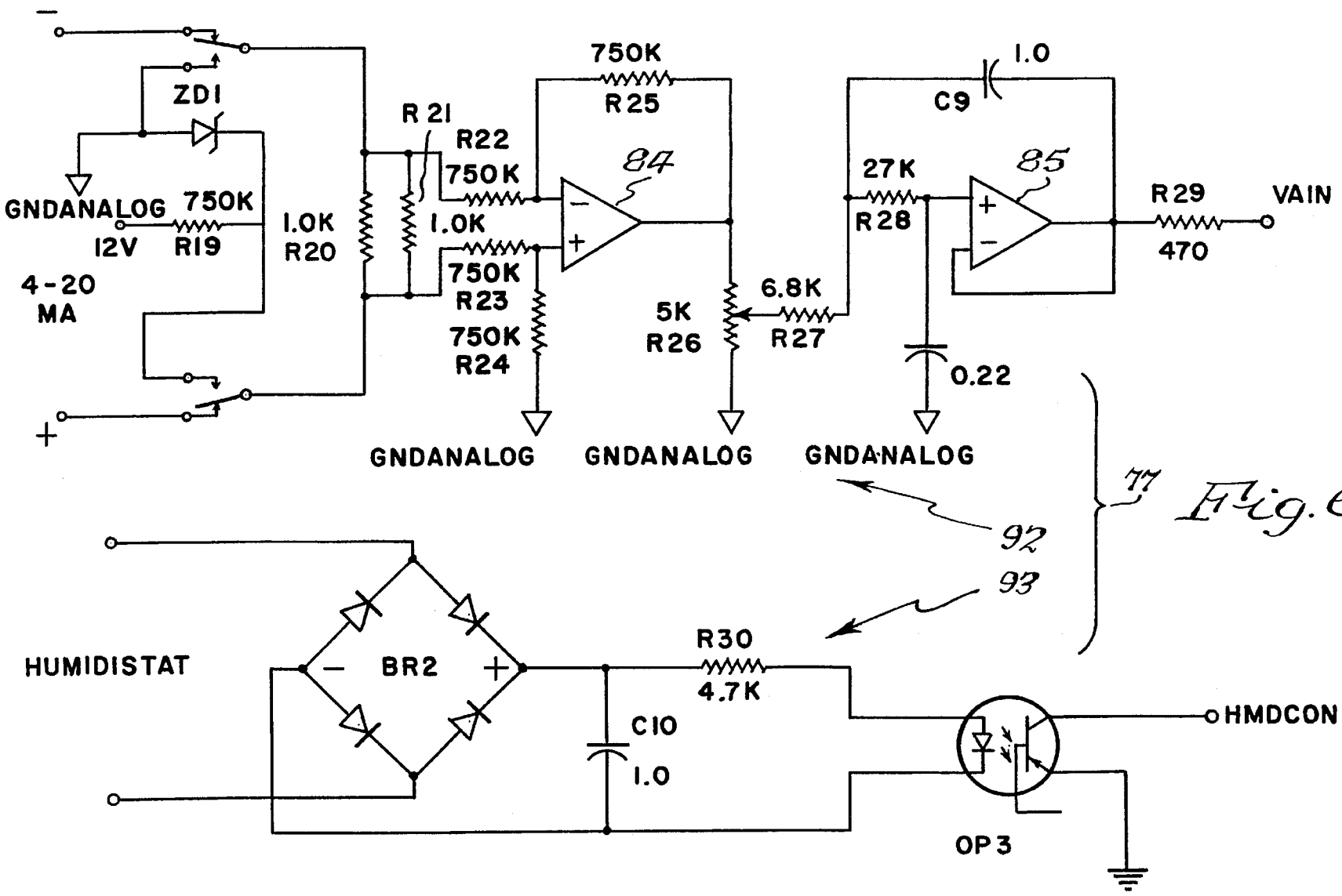
FIG. 6 is a schematic diagram of the system control signal inputs.

Control signal circuitry 77, shown schematically in FIG. 6, accepts the system humidity demand control signals ($IN_1$ and $IN_2$.) The signals can be one of two types: a) proportional control signal (e.g., $IN_1$), conventionally 4–20 ma or 2–10 volts or b) on/off contact closure (e.g., $IN_2$), conventionally a humidistat applying 24 VAC to the input circuitry.

Figure 7:
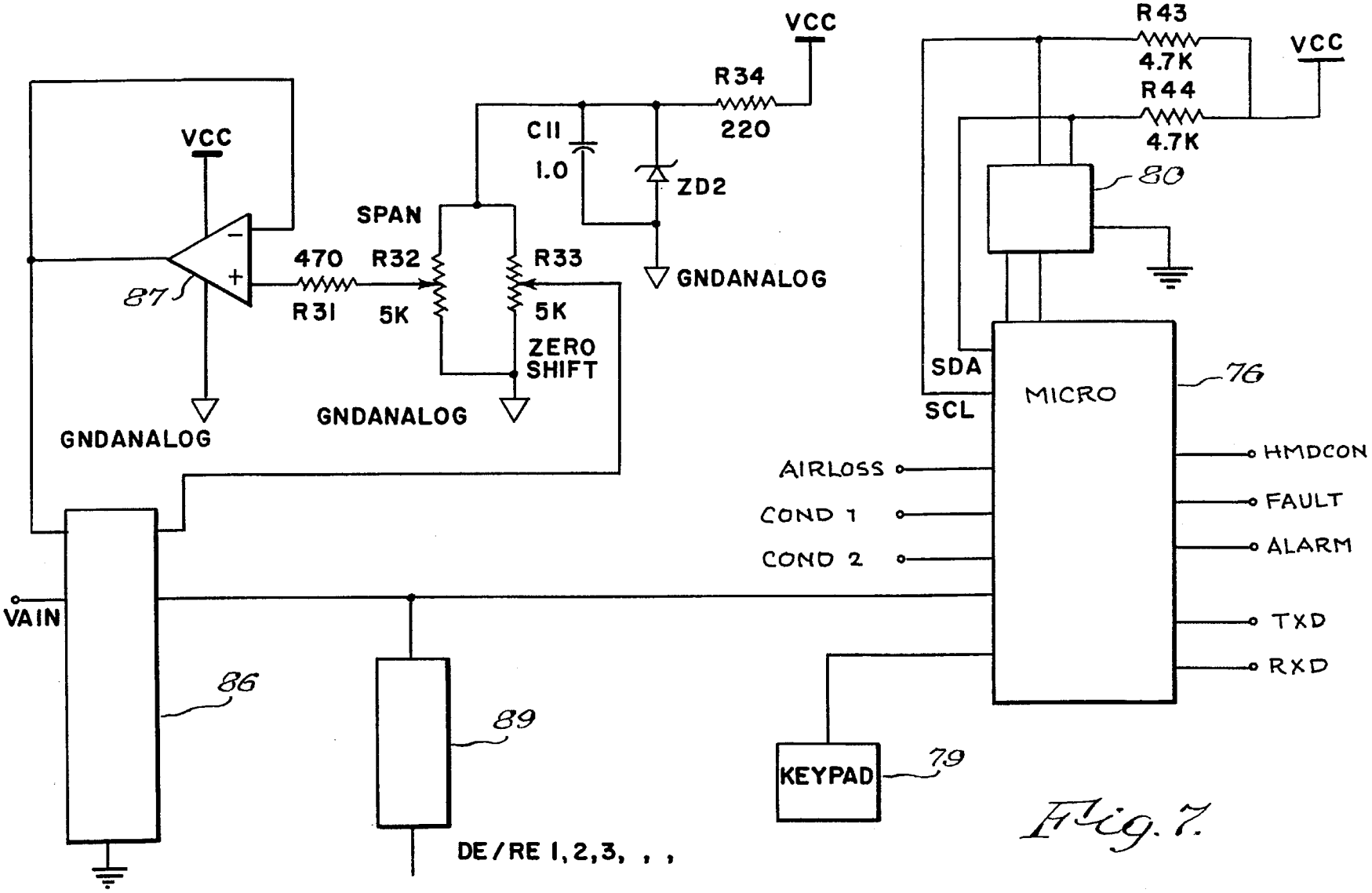
FIG. 7 is a partial block diagram and partial schematic diagram of the system controller.

Proportional signal circuitry 92 performs signal conditioning and analog to digital conversion of input signal $IN_1$. Operational amplifier 84 (National Semiconductor LM358AN or equivalent) is configured as a differential amplifier to reject any common mode noise appearing on the input signal line. Op amp 85 is configured as a low pass filter with a cutoff frequency of 20 Hz. This assures that no high frequency signals will be presented to analog to digital converter 86 (shown in FIG. 7) which would cause incorrect conversion of the analog signal. The output of the filter is applied to the input of analog to digital converter 86 (National Semiconductor ADC0804LCNA or equivalent). The analog to digital converter is an 8 bit device yielding 256 increments in the proportional signal, but not limited to this (i.e., a 10, 12, or 16 bit A/D converter could be used for greater accuracy. The humidifier would have to be set up for the same number of bits in order to realize more accurate control of humidity. The output of the analog to digital converter is read by microprocessor 76. Resistors $R_{32}$ and $R_{33}$, and op amp 87 (all shown in FIG. 7) are used to adjust the zero point and full scale point of the analog to digital converter.

Alternatively, contact closure circuitry 93 performs signal conditioning and conversion from a high DC voltage to a digital voltage. When the contacts of humidistat 26 close, a 24 VAC demand signal ($IN_2$) is applied to bridge rectifier $BR_2$ and filter components $R_{30}$ and $C_{10}$, which convert the 24 VAC signal to a DC voltage. Opto-isolator $OP_3$ (a Motorola 4N25 or equivalent) converts the rectified AC voltage to a digital voltage which is applied to the microprocessor. The signal is a logic high for 'ON' and a logic low for 'OFF'.

System Fault Signals

System fault signals are typically airloss and water quality related. However they can be any type of system fault depending on the particular installation. Regardless of the fault, the signal is typically 24 VAC applied on fault. The system response is also totally configurable to the installation requirements as the system is based on microprocessor control (software based). For example, in some systems, airloss is used as a control signal to shut down the humidification system when the air fans are shut down for the night. In other systems this airloss would be an alarm condition.

Figure 8A:
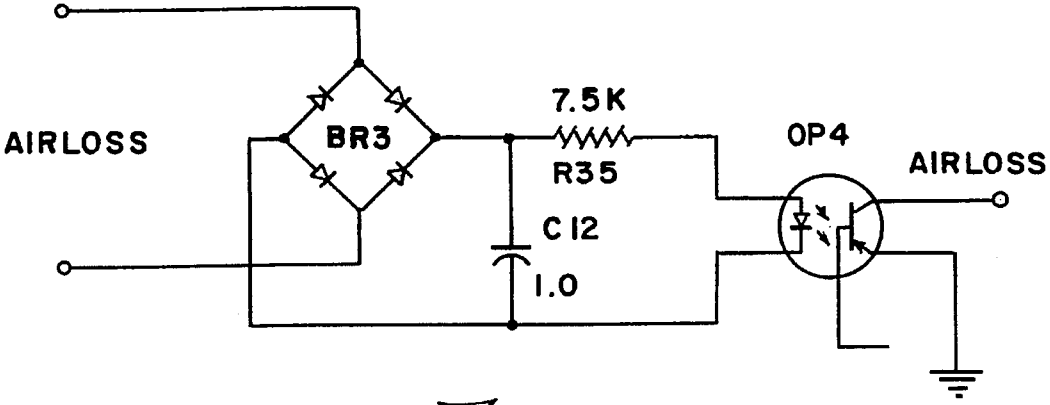
FIGS. 8A, 8B and 8C illustrate system fault signal inputs.
Figure 8B:
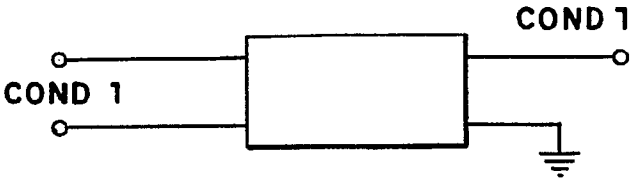
Figure 8C:
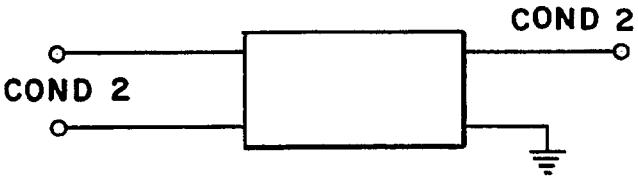

Fault signal circuits 78 (FIG. 5) are shown schematically in FIGS. 8A, 8B and 8C. The three fault circuits are identical, so for simplicity only the airloss circuit is shown in detail. The other two circuits, $COND_1$ and $COND_2$, might be used to sense a water overflow or a water quality alarm signal from the water treatment apparatus, for example. The circuit comprises bridge rectifier $BR_3$, filter components $R_{35}$ and $C_{12}$ and opto-isolator $OP_4$. The 24 VAC is rectified and filtered. The opto-isolator converts the rectified ac voltage to a logic level for the microprocessor.

Microprocessor

Microprocessor 76 monitors the system alarm inputs, keypad, reads the analog to digital converter, communicates to the liquid crystal display (LCD), and transmits and receives data under software control. A non-volatile memory 80 (National Semiconductor NM24C08N or equivalent) is used to store setup data and all the display text for the LCD.

Communication Ports

Figure 8D:
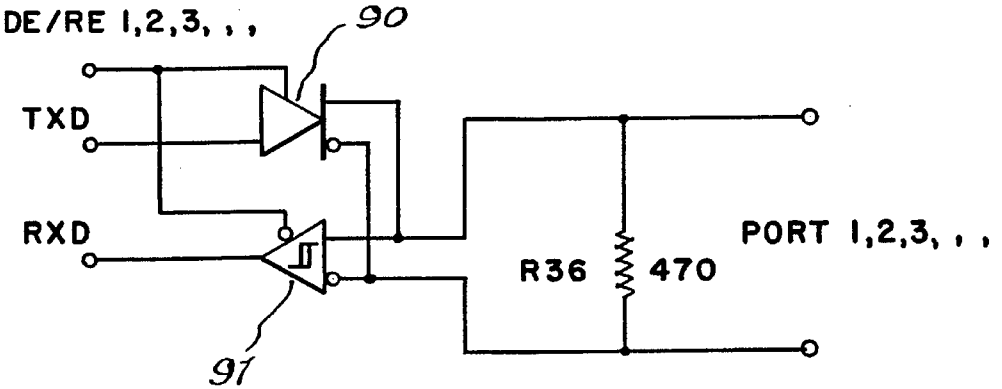
FIG. 8D illustrates a typical communication port.

Communication ports 82 comprise 8 ports in a preferred embodiment. The communication ports (Linear Technology LTC485CN8 or equivalent) are RS-485 transceivers. A typical port is shown schematically in FIG. 8D. The system controller uses the communication port to transmit control commands and output level data to the humidifiers along digital communication lines. The system controller also receives humidifier status data from each humidifier as it is polled. The system controller can communicate with up to eight humidifiers. The direction of communications is controlled by the microprocessor and latch 89 (74LS373 or equivalent, shown in block diagram in FIG. 7). The direction of each port can be set independently depending on the code sent to the latch. The latch outputs connect to the direction pins of the RS-485 integrated circuits.

User Interface

The user interface comprises keypad 79 and liquid crystal display 81. The keypad allows the user to control the humidifiers by accessing menu driven programs in the microprocessor. The microprocessor monitors the keypad for any action. If a key is pressed the micro responds with an audible tone from buzzer $BZ_1$, and the display changes to reflect the selected action. The keypad and display connect directly to the microprocessor on a data bus.

Alarm Outputs

Figure 9A:
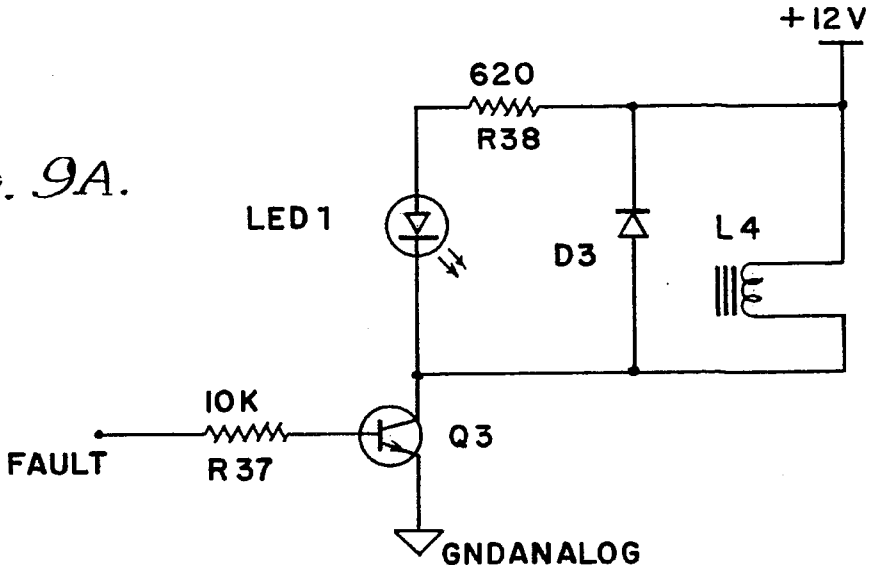
FIGS. 9A and 9B illustrate visual and audible alarm circuits, respectively.
Figure 9B:
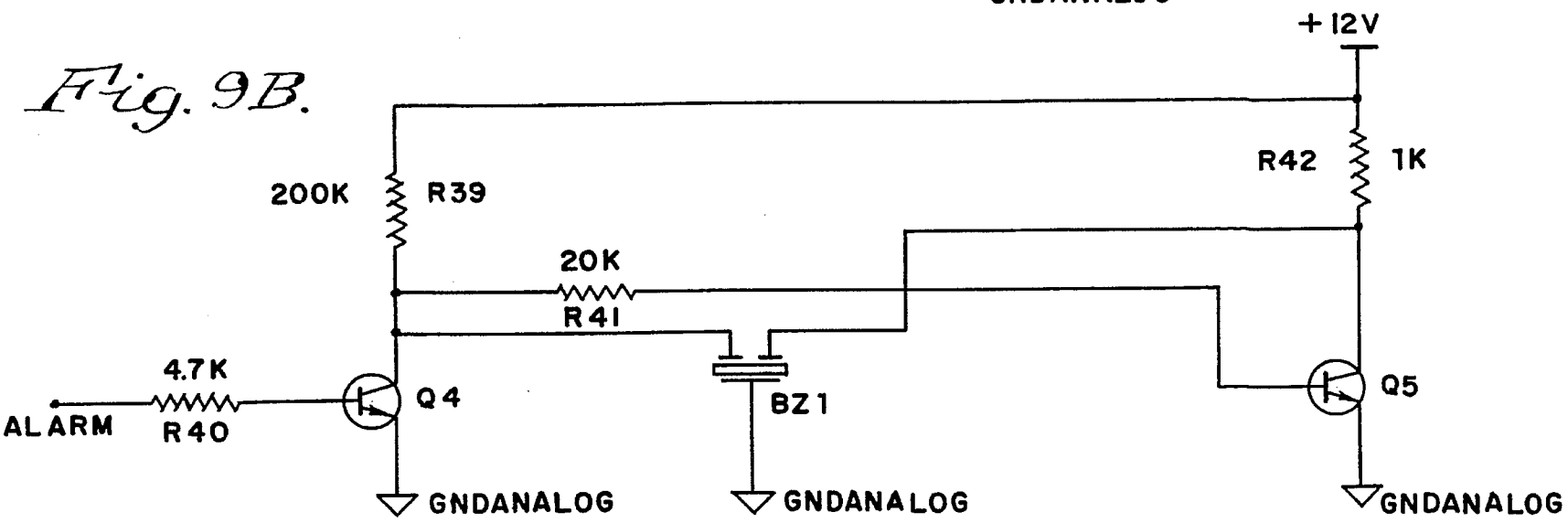

Alarm outputs 83 are visual ($LED_1$ shown in FIG. 9A), audible (buzzer BZ1 shown in FIG. 9B), and hardwired (standard relay contact, not shown). In a preferred embodiment, the audible alarm can be silenced from the keypad by the user. The other alarms can only be cleared after the fault has been cleared.

Microfiche Appendix

The microfiche appendix includes the following files:

1. Filename: Init.c Program: Syscon.c
   This code initializes the microprocessor port pins and internal registers at power up, on the system controller board.
2. Filename: Syscon.c Program: Syscon.c
   This is the source code software to enable the system controller board to operate the LCD (liquid crystal display), read the analog to digital converter, communicate to the humidifiers, accept input from the keypad and set alarms.
3. Filename: Init.c Program: Remcon.c
   This code initializes the microprocessor port pins and internal registers at power up, on the remote controller board.

4. Filename: Remcon.c Program: Remcon.c

This is the source code for the microprocessor to control the operation of the humidifier, and communicate with the system controller.

Thus, it is seen that the objects of the invention are efficiently obtained. Although a preferred embodiment is disclosed which represents the best mode of practicing the invention at the present time, it is to be understood that changes and modifications to the invention may be made by those having ordinary skill in the art, without departing from the spirit or scope of the appended claims.

What is claimed is:

1. A circuit for causing an element to provide a response which is linearly proportional to an input signal comprising input signal means for providing an input signal, a microprocessor coupled to said input signal means for receiving said input signal and producing a first output signal which is dependent on the characteristics of a transistor oscillator to which it is coupled for the purpose of causing said transistor oscillator to provide an output other than which it would produce if said input signal means were coupled directly to said transistor oscillator, a transistor oscillator coupled to said microprocessor for receiving said first output signal and producing a second output signal which is linearly proportional to said input signal, and an element coupled to said transistor oscillator for receiving said second output signal and providing a response which is linearly proportional to said input signal.

2. A circuit as recited in claim 1 wherein said element is a transducer for converting water to mist.

3. A circuit as recited in claim 2 wherein said transducer is a piezo-electric crystal.

4. A circuit as recited in claim 2 further including means for adjusting said circuit to ensure that said transducer provides no mist for a first predetermined output signal and provides maximum mist for a second predetermined output signal.

5. A circuit as recited in claim 2 wherein said circuit includes means for detecting a fault in said electrical circuit and communicating said fault to said microprocessor means, and wherein said circuit includes adjustment means for overcoming operational discrepancies inherent in variances in said circuit.

6. A circuit as recited in claim 5 wherein said adjustment means for overcoming operational discrepancies inherent in variances in said circuit comprises means for adjusting said circuit to ensure that said transducer provides no mist for a first predetermined output signal and provides maximum mist for a second predetermined output signal.

7. A circuit as recited in claim 6 in combination with a tank having water therein and wherein said circuit includes means for measuring water level in said tank and for preventing water flow into said tank if said level reaches a preset maximum level and for shutting down said circuit if the measured water level falls below a preset minimum.

8. A circuit as recited in claim 7 wherein said circuit includes means for shutting down said circuit in the event of overheating proximate said tank.

9. A circuit as recited in claim 8 wherein said circuit includes means for detecting a leak in said tank.

10. A circuit as recited in claim 1 wherein said circuit includes means for detecting a fault in said electrical circuit and communicating said fault to said microprocessor means.

11. A circuit as recited in claim 10 wherein said circuit includes adjustment means for overcoming operational discrepancies inherent in variances in said circuit.

12. A circuit as recited in claim 1 wherein said circuit includes adjustment means for overcoming operational discrepancies inherent in variances in said circuit.

13. A circuit as recited in claim 12 wherein said element comprises a transducer for converting water to mist and wherein said adjustment means comprises means for adjusting said circuit to ensure that said transducer provides no mist for a first predetermined output signal and provides maximum mist for a second predetermined output signal.

14. A circuit as recited in claim 13 wherein said circuit includes means for detecting a fault in said electrical circuit and communicating said fault to said microprocessor means.

15. A circuit as recited in claim 14 in combination with a tank having water therein and wherein said circuit includes means for measuring water level in a tank and for preventing water flow into said tank if said level reaches a preset maximum level and for shutting down said circuit if the measured water level falls below a preset minimum.

16. A circuit as recited in claim 15 wherein said circuit includes means for detecting a leak in said tank.

17. A circuit as recited in claim 1 in combination with a tank having water therein and wherein said circuit includes means for measuring water level in said tank and for preventing water flow into said tank if said level reaches a preset maximum level and for shutting down said circuit if the measured water level falls below a preset minimum.

18. A circuit as recited in claim 17 wherein said circuit includes means for shutting down said circuit in the event of overheating proximate said tank.

19. A circuit as recited in claim 17 wherein said circuit includes means for detecting a leak in said tank.

20. A circuit as recited in claim 1 wherein said second output signal of said transistor oscillator is of constant frequency.

21. A system for producing controlled humidification to an area comprising a piezo-electric crystal for producing ultrasonic vibration to nebulize water for humidification, oscillator means for exciting said piezo-electric crystal, sensor means for sensing the humidity level and comparing said sensed humidity level in said area with a preset desired humidity level and generating a humidity demand signal, and control means for causing said oscillator means to produce an output of an amplitude which varies substantially linearly with respect to said humidity demand signal to drive said piezo-electric crystal at said amplitude which varies substantially linearly with respect to said humidity demand signal.

22. A system as recited in claim 21 wherein said control means comprises a microprocessor.

23. A system as recited in claim 22 including circuit means for detecting faults in said circuit and communicating said faults to said microprocessor.

24. An apparatus for providing controlled excitation to a plurality of elements which generate ultrasonic waves, comprising: input bias signal means for providing an input bias signal, a plurality of transistor oscillator circuits coupled to said input bias signal means, a plurality of elements coupled to said transistor oscillator circuits, each of said transistor oscillator circuits providing an electrical output signal of a variable amplitude to excite one of said elements in response to said input bias signal, wherein the amplitude of said electrical output signal from each of said transistor oscillator circuits would normally vary non-linearly with respect to said input bias signal; microprocessor means for correcting for the non-linear relationship between said input bias signal and said electrical output signal, wherein said microprocessor means receives an input signal and transmits a single output control signal in response thereto to each of said transistor oscillator circuits which, in turn, causes each of said transistor oscillator circuits to produce a corrected electrical output signal whose amplitude varies linearly with respect to said input signal; and a corresponding plurality of variance adjustment circuits coupled to said transistor oscillator circuits which ensure that the amplitude of said corrected electrical output signal for each of said oscillator circuits is substantially the same in response to said output control signal.

25. An apparatus as recited in claim 24 wherein said apparatus is a nebulizer used to convert water to mist for the purpose of humidification.

26. Apparatus as recited in claim 25 further including means for detecting a fault in said oscillator circuits or said elements and communicating the same to said microprocessor means.

27. Apparatus as recited in claim 24 wherein said elements are piezo-electric crystals.

28. Apparatus as recited in claim 24 further including means for detecting a fault in said oscillator circuits or said elements and communicating said fault to said microprocessor means.

29. Apparatus as recited in claim 24 further including means for adjusting each circuit individually to ensure that a first predetermined control signal results in zero mist being produced by said element and a second predetermined control signal results in maximum mist being produced by said element.

30. A circuit as recited in claim 24 wherein said circuit includes means for measuring water level in a tank and for preventing water flow into said tank if said level reaches a preset maximum level and for shutting down said circuit if the measured water level falls below a preset minimum.

31. A circuit as recited in claim 30 wherein said circuit includes means for shutting down said circuit in the event of overheating proximate said tank.

32. A circuit as recited in claim 31 wherein said circuit includes means for detecting a leak in said tank.

33. A system for producing controlled humidification comprising: a plurality of humidity sensing means for measuring humidity levels in a plurality of locations; a plurality of humidifiers for providing humidification to said plurality of locations; a plurality of remote controllers corresponding to said plurality of humidifiers, where each remote controller controls an individual humidifier; and, a system controller responsive to a demand signal derived from at least one of said plurality of sensing means and in communication with said plurality of humidifiers and with said plurality of remote controllers, where said system controller functions as an interface between said plurality of sensing means and said plurality of humidifiers and said plurality of remote controllers, wherein said system controller sends a proportional humidity demand signal to each of said remote controllers; wherein each of said remote controllers provides linear control of its respective humidifier in response to said proportional humidity demand signal.

34. A humidification system comprising a sensing means for sensing the demand for humidification in an area and providing a demand signal representative thereof, a plurality of remote controllers, a system controller coupled to sensing means for monitoring the operational status of a plurality of humidifiers and for providing an interface between said demand signal produced by said sensing means and said plurality of remote controllers, a plurality of transducer drive circuits coupled to each of said remote controllers, each of said transducer drive circuits comprising a transistor oscillator and a transducer coupled thereto, each said remote controllers including a microprocessor for receiving said demand signal and producing a first output signal for causing each of said transistor oscillators to produce a second output signal which is linearly proportional to said demand signal to thereby drive its respective transducer at an amplitude which is linearly proportional to said demand signal.

35. A humidification system as set forth in claim 34 including a variance adjust circuit in each of said transducer drive circuits for adjusting for operational variances in each of said transistor oscillators and said transducers.

* * * * *